US008024880B2

(12) United States Patent
Kuan et al.

(10) Patent No.: US 8,024,880 B2
(45) Date of Patent: Sep. 27, 2011

(54) COMBINATION EXIT SIGN AND EMERGENCY LIGHT BAR

(75) Inventors: Ping Shuo Kuan, Taoyuan (TW); Jeffrey S. Katz, Pickerington, OH (US)

(73) Assignee: Best Lighting Products, Inc., Pataskala, OH (US)

( * ) Notice: Subject to any disclaimer, the term of this patent is extended or adjusted under 35 U.S.C. 154(b) by 28 days.

(21) Appl. No.: 12/773,284

(22) Filed: May 4, 2010

(65) Prior Publication Data

US 2010/0275478 A1 Nov. 4, 2010

Related U.S. Application Data

(60) Provisional application No. 61/175,160, filed on May 4, 2009.

(51) Int. Cl.
*G09F 13/04* (2006.01)

(52) U.S. Cl. ..... 40/570; 362/812

(58) Field of Classification Search ..... 40/570, 40/553, 558; 362/812
See application file for complete search history.

(56) References Cited

U.S. PATENT DOCUMENTS

| | | | | | |
|---|---|---|---|---|---|
| 1,469,946 | A * | 10/1923 | Morrison | 40/570 |
| 2,893,148 | A * | 7/1959 | Figman | 40/576 |
| 3,573,541 | A | 4/1971 | Dunn et al. | |
| 3,916,404 | A | 10/1975 | Gouge | |
| 3,931,689 | A * | 1/1976 | Shine | 40/570 |
| 4,435,743 | A * | 3/1984 | Plumly | 362/20 |
| 4,521,835 | A | 6/1985 | Meggs et al. | |
| 5,018,290 | A | 5/1991 | Kozek et al. | |
| 5,410,453 | A | 4/1995 | Ruskouski | |
| 5,428,912 | A | 7/1995 | Grondal et al. | |
| 5,446,440 | A | 8/1995 | Gleason et al. | |
| 5,954,423 | A | 9/1999 | Logan et al. | |
| 6,026,602 | A | 2/2000 | Grondal et al. | |
| 6,056,420 | A | 5/2000 | Wilson et al. | |
| 6,646,769 | B1 | 11/2003 | Fang | |
| 6,741,324 | B1 | 5/2004 | Kim | |
| 6,824,295 | B1 | 11/2004 | Grondal | |
| 6,848,798 | B1 * | 2/2005 | Logan et al. | 362/20 |
| 6,860,628 | B2 | 3/2005 | Robertson et al. | |
| 7,114,830 | B2 | 10/2006 | Robertson et al. | |
| 2002/0196623 | A1 | 12/2002 | Yen | |
| 2006/0215403 | A1 | 9/2006 | Martineau | |
| 2007/0064409 | A1 | 3/2007 | Hulse | |
| 2008/0276509 | A1 * | 11/2008 | Yu | 40/570 |

* cited by examiner

*Primary Examiner* — Gary Hoge
(74) *Attorney, Agent, or Firm* — Diederiks & Whitelaw, PLC

(57) ABSTRACT

A combination exit sign and emergency light is provided, wherein the emergency light is disposed along a bottom, portion of the exit sign. The bottom portion of the housing is formed with a recessed section intermediate opposing side flange portions, with a light bar incorporating LEDs being mounted in the recess section to provide emergency lighting during power outages and emergency situations. The bar is white in color on the outside, except a bottom portion of the bar is left clear for the free transmission of light. With this construction, at least a substantial majority of fight generated by the LEDs will be directed out of the bottom portion, while the side portions are also preferably lit thereby providing a more intense light out of the bottom portion to assure adequate illumination leading to a suitable exit.

17 Claims, 3 Drawing Sheets

COMBINATION EXIT SIGN AND EMERGENCY LIGHT BAR

CROSS-REFERENCE TO RELATED APPLICATIONS

The present application claims the benefit of U.S. Provisional Patent Application Ser. No. 61/175,160 entitled "Combination Exit Sign and Emergency Light Bar" filed May 4, 2009.

BACKGROUND OF THE INVENTION

1. Field of the Invention

The present invention pertains to the art of exit signs and, more particularly, to a combination exit sign and emergency light incorporating an elongated light bar housing a series of LEDs.

2. Discussion of the Prior Art

Exit signs are commonly found in essentially all commercial buildings in general, the purpose of an exit sign is to direct a person's attention to the location of a suitable building exit. To achieve this function, it is known to provide exit signs along corridors in order to lead one to an exit, as well as directly adjacent the exit itself. Typically, such exit signs are mounted on surrounding walls or suspended from a ceiling. In any case, exit signs mark the way for people leaving a building.

In the event of an emergency, such as a building fire, exit signs can play a crucial role in enabling people to safely leave the building in a timely manner. Typically, an audible fire alarm is sounded as an initial indicator of the presence for possibility of a fire. In addition, strobe lights are also often used as visual indicators in such emergency situations, especially in large scale commercial buildings such as hotels, hospitals, convention centers, large office buildings and the like. Furthermore, it is known in the art to provide auxiliary lighting on the housing of an exit sign in order to illuminate the area leading to and around the exit. In accordance with the prior art, such lighting can either be fixed in a certain position relative to the housing of the exit sign or permitted to be adjusted to some limited extent.

Regardless of the existence of combination exit signs with emergency lighting, there is still considered to exist a need in the art for an exit sign incorporating an emergency light fixture arrangement which exhibits high energy efficiency and is compact in construction, yet still provides an effectively directed source of illumination in the event of an emergency.

SUMMARY OF THE INVENTION

In accordance with the present invention, a combination exit sign and emergency light is provided, wherein the emergency light is disposed along a bottom edge portion of the exit sign. More specifically, the exit sign includes a housing defined, at least in part, by a front wall and a peripheral side wall establishing top, opposing side and bottom wall portions. The bottom wall of the housing is formed with a recessed section intermediate opposing side flange portions. The recessed section defines an elongated cavity which is exposed from both the front and bottom walls. Disposed within the cavity and extending laterally between the opposing side flange portions is a light bar incorporating LEDs which are adapted to provide emergency lighting during power outages and emergency situations.

In accordance with the most preferred embodiment of the invention, the light bar includes a pipe or tube housing a strip of the LEDs, preferably white LEDs, which are countersunk into a top of the bar. The bar is white in color on the outside, except a bottom portion of the bar is left clear for the free transmission of light. In one form of the invention, the bar is made of acrylic, with the white part of the bar being frosted or covered with a translucent coating so as to glow when lit in an emergency mode of operation.

With this configuration, the construction of the housing and the mounting of the light bar in the cavity provides an extremely compact arrangement. In addition, the use of the LEDs in combination with the structure of the light bar establishes a highly energy efficient lighting system which can provide a high degree of effectively directed illumination in emergency situations.

Additional objects, features and advantages of the present invention will become more readily apparent to one of ordinary skill in the art from the following description of a preferred embodiment, particularly when taken in conjunction with the drawings wherein like reference numerals reference corresponding structure in the several views.

DETAILED DESCRIPTION OF THE PREFERRED EMBODIMENT

Figure 1:
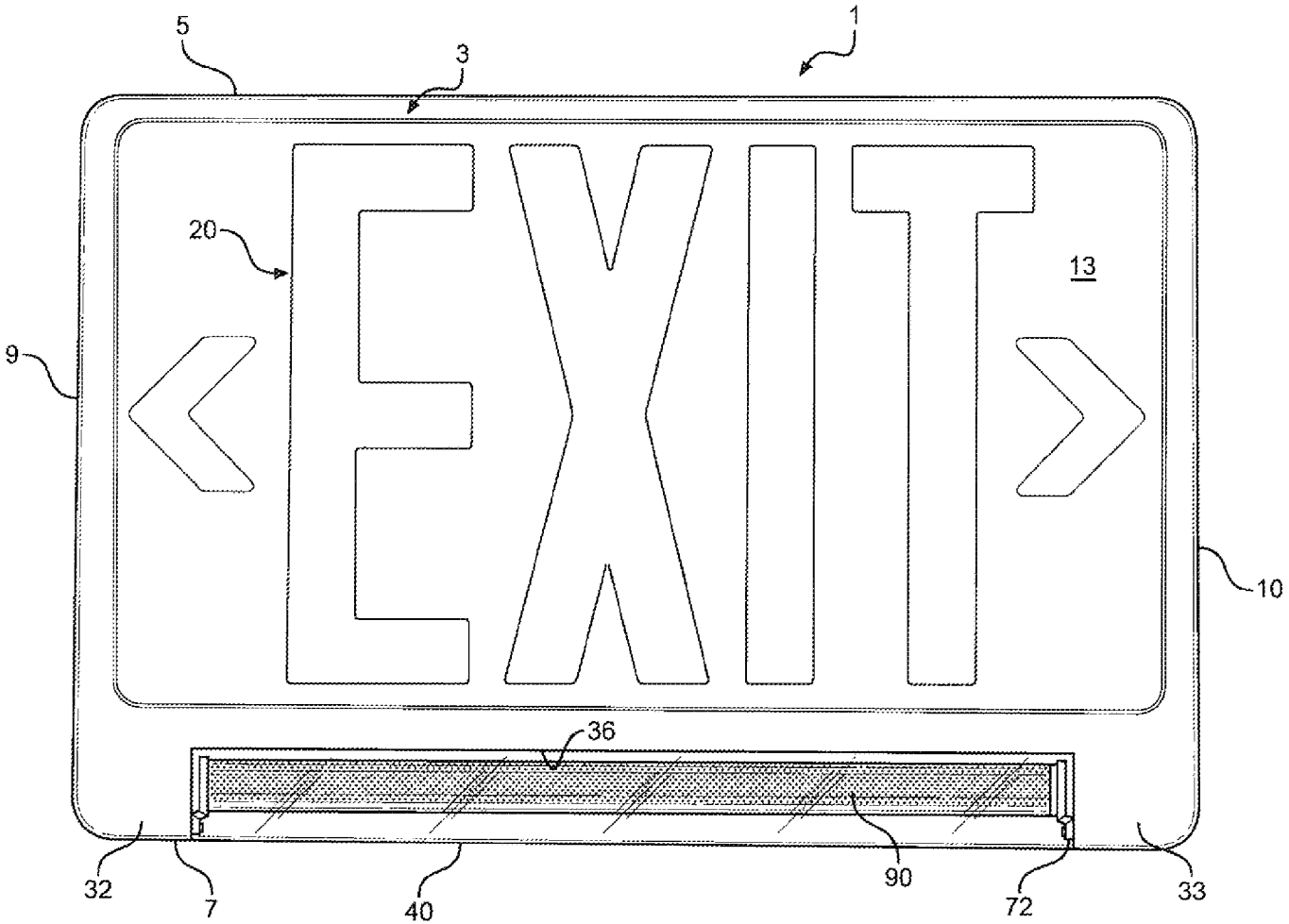
FIG. 1 is a front elevational view of an exit sign, incorporating an emergency LED light bar constructed in accordance with the present invention.

With initial reference to FIG. 1, an exit sign constructed in accordance with the invention is generally indicated at 1. Exit sign 1 includes a housing 3 having a top 5, a bottom 7, a left lateral side 9, a right lateral side 11, a substantially planar front surface 13 and a planar rear surface (not shown). In the preferred embodiment, front surface 13 includes various cutout regions that exhibit letters/symbols 20. Although letters/symbols 20 are shown in FIG. 1 expressing the word EXIT, with chevrons on either side of this term, it is considered within the scope of this invention that any combination of letters or symbols may be expressed on front surface 13 or, in fact, the opposing rear surface.

A lighting system (not shown) is located within housing 3 and may be constituted by any conventional illumination system to light up letters/symbols 20. For example, the lighting system may simply include a single light bulb centrally located within housing 3 to shine through partially transparent or translucent letters/symbols 20. In an alternative, the lighting system may include a separate incandescent light bulb for each of the individual symbols of letters/symbols 20. The lighting system may also include a series of LEDs forming the individual symbols of letters/symbols 20, as known in the art. In a manner also known in the art, exit sign 1 is adapted to be connected to a primary power source (not shown), e.g. AC, and a secondary power source, e.g. an internal battery, for when the primary power source fails. However, the power sources and specific lighting system within housing 3 do not form part of the present invention.

Figure 2:
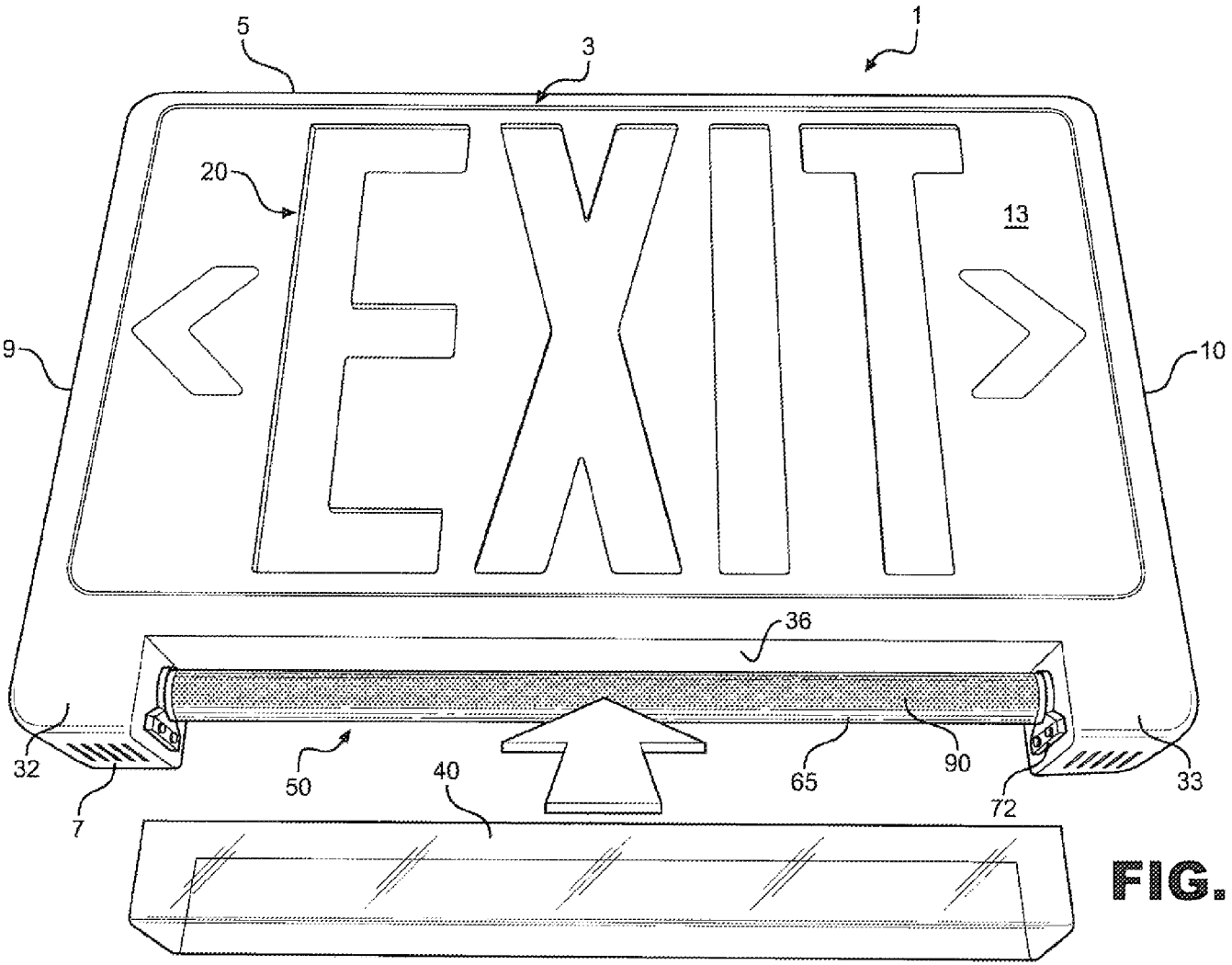
FIG. 2 is a perspective view of the exit sign of FIG. 1 with a lower portion thereof shown partially exploded.

FIGS. 1 and 2 also show housing 3 to include a bottom edge portion 30 defined by opposing side flange portions 32, 33 and an intermediate, recessed section 36. Recessed section 36 has extending thereacross a clear, preferably acrylic cover 40. Cover 40 is U-shaped in cross-section and preferably snap-connected to housing 3 so as to be selectively removable. Upon removing cover 40, an elongated cavity 50 is exposed. In accordance with the invention, within elongated cavity 50 is provided an emergency light bar 65. During an emergency situation, such as in the case of a power failure or fire in a building, light bar 65 will be automatically activated in order to illuminate the area leading to and around exit sign 1. The present invention is particularly directed to the structure and operation of light bar 65 as will be detailed further below.

Figure 3:
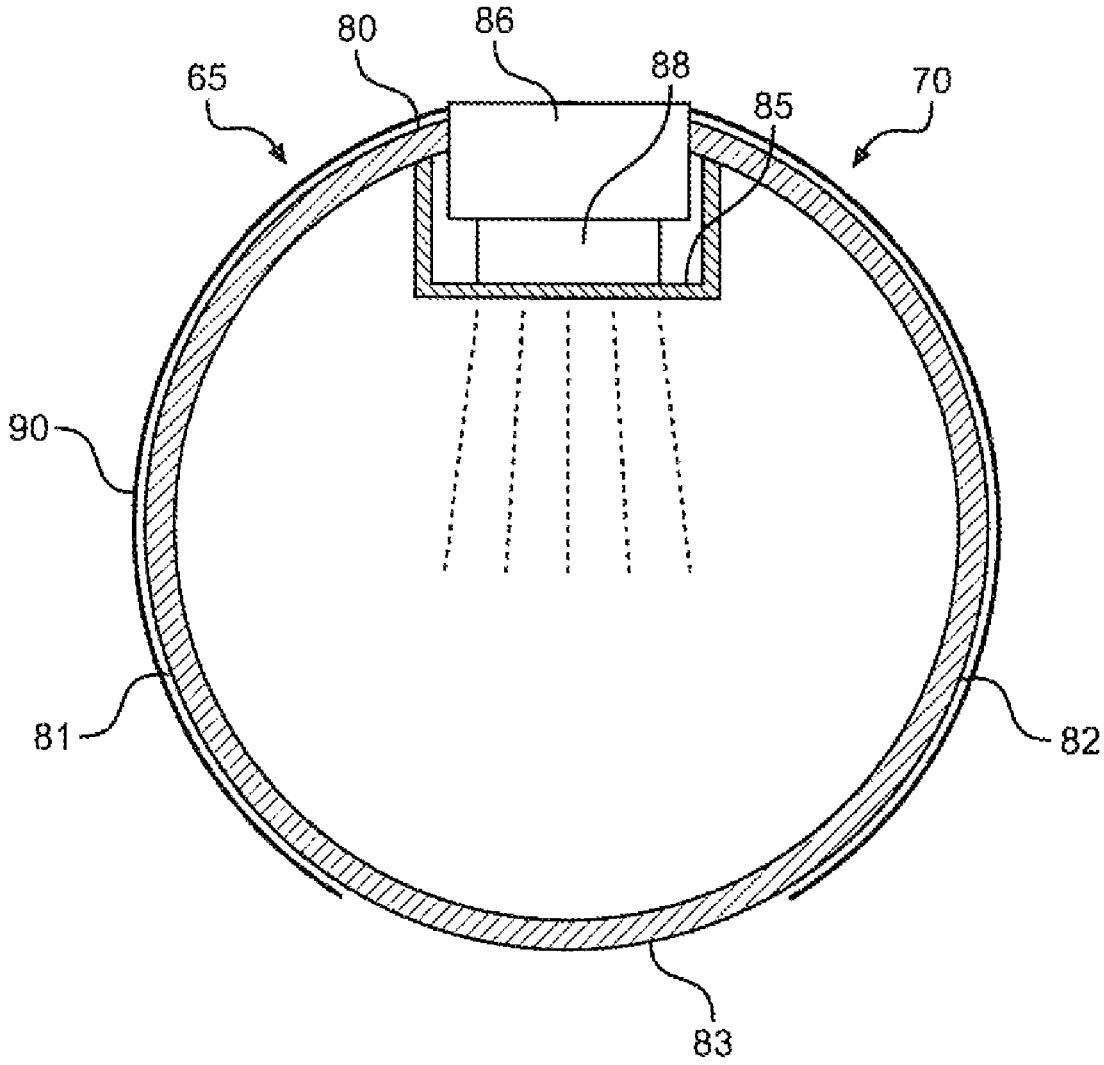
FIG. 3 is a schematic side view of the light bar employed in the invention.

With reference to FIGS. 2 and 3, light bar 65 includes a main body 70 shown in the form of a round pipe or tube removably mounted in elongated cavity 50 through end brackets 72. As will become more fully apparent below, main body 70 could also take various polygonal shapes without departing from the invention. In any case, main body 70 generally includes a top portion 80, side portions 81 and 82, and a bottom portion 83. Formed in top portion 80 is an elongated channel 85 extending a substantial majority across the length of main body 70 and within which is mounted a PCB 86 supporting and electrically connected to a series or strip of LEDs 88. With this construction, LEDs 88, and preferably at least a portion of PCB 86, are countersunk into main body 70.

As shown, side portions 81 and 82 are made substantially translucent, preferably by providing side portions 81 and 82 with a white or other colored coating 90, whether in the form of a film or paint layer. In another form of the invention, side portions 81 and 82 are frosted (90). In a further form of the invention, side portions 81 and 82 are covered with a translucent coating 90 so as to glow in an emergency mode of operation of exit sign 1. In a still further form of the invention, reflective tape can be provided on side portions 81 and 82 to define coating 90. On the other hand, bottom portion 83 is clear or transparent and, in fact, can actually be defined by a cut-out of main body 70 so as to be open to LEDs 88.

With this construction, at least a substantial majority of light generated by the series or strip of LEDs 88 during operation of light bar 65 will be directed out of bottom portion 83, while the side portions 81 and 82 are also preferably lit. This overall arrangement is considered to provide enhanced visual effectiveness during emergency situations by providing soft light on the side portions 81 and 82 of light bar 65 for the direct front view of exit sign 1 by individuals, while also providing a more intense light out of bottom portion 83 to assure the adequate illumination leading to a suitable exit.

Although described with reference to preferred embodiments, it should be readily understood that various changes and/or modifications could be made to the invention without departing from the spirit thereof. It must also be noted that relative terms such as top, bottom, left and right are included for ease of understanding, and are not to be considered as limiting with regards to the above-described invention.

We claim:

1. A combination exit sign and emergency light comprising:

a housing having a front face, opposing lateral sides and a bottom edge portion defined by opposing side flange portions spaced by an intermediate, recessed section establishing an elongated cavity;

symbols provided on the front face adapted to be illuminated; and a lighting system including a light bar mounted within the elongated cavity, said light bar including:

a main body having a top portion, side portions and a bottom portion, at least said bottom portion being transparent;

an elongated channel formed in the top portion; and a strip of LEDs projecting into the channel wherein, during emergency situations, the LEDs are activated to direct light into the main body of the light bar, with at least a substantial majority of the light being directed out the bottom portion of the main body.

2. The combination exit sign and emergency light according to claim 1, wherein the elongated channel extends across a majority of the main body.

3. The combination exit sign and emergency light according to claim 1, further comprising: a PCB board mounted within the channel, with the LEDs being supported by and electrically connected to the PCB board.

4. The combination exit sign and emergency light according to claim 1, further comprising: a transparent cover extending across the recessed section between the opposing side flanges.

5. The combination exit sign and emergency light according to claim 4, wherein the cover is made of acrylic.

6. The combination exit sign and emergency light according to claim 4, wherein the cover is snap-connected to the housing so as to be selectively removable.

7. The combination exit sign and emergency light according to claim 1, further comprising: a colored coating provided on the side portions of the light bar, said colored coating enabling the side portions to be lit by the LEDs, yet assuring that a majority of light from the LEDs is directed out of the bottom portion.

8. The combination exit sign and emergency light according to claim 7, wherein the coating extends from the top portion across the side portions, while leaving the bottom portion exposed.

9. The combination exit sign and emergency light according to claim 1, wherein the light bar is constituted by a pipe or tube.

10. A combination exit sign and emergency light comprising:

a housing having a front face, opposing lateral sides and a bottom edge portion defined by opposing side flange portions spaced by an intermediate, recessed section establishing an elongated cavity;

exit symbols provided on the front face adapted to be illuminated; and a lighting system including a light bar mounted within the elongated cavity, said light bar including:

a main body in the form of a pipe or tube having a top portion, side portions and a bottom portion;

a strip of LEDs provided in the main body; and a colored coating provided on the side portions of the main body but not on the bottom portion wherein, during emergency situations, the LEDs are activated to direct light into the main body of the light bar, with said colored coating enabling the side portions to be lit by the LEDs, yet assuring that a majority of light from the LEDs is directed out of the bottom portion.

11. The combination exit sign and emergency light according to claim 10, wherein the LEDs are countersunk in the main body.

12. The combination exit sign and emergency light according to claim 10, further comprising: a PCB board mounted within the main body, with the LEDs being supported by and electrically connected to the PCB board.

13. The combination exit sign and emergency light according to claim 10, further comprising: a transparent cover extending across the recessed section between the opposing side flanges.

14. The combination exit sign and emergency light according to claim 13, wherein the cover is made of acrylic.

15. The combination exit sign and emergency light according to claim 13, wherein the cover is snap-connected to the housing so as to be selectively removable.

16. The combination exit sign and emergency light according to claim 10, wherein the coating extends from the top portion across the side portions, while leaving the bottom portion exposed.

17. The combination exit sign and emergency light according to claim 10, wherein the light bar is constituted by a pipe or tube.

* * * * *